US007975663B2

(12) United States Patent
Davis

(10) Patent No.: US 7,975,663 B2
(45) Date of Patent: Jul. 12, 2011

(54) DUAL-EQUAL CAM PHASING WITH VARIABLE OVERLAP

(75) Inventor: Richard Stephen Davis, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 613 days.

(21) Appl. No.: 12/103,356

(22) Filed: Apr. 15, 2008

(65) Prior Publication Data

US 2009/0255497 A1 Oct. 15, 2009

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,725,817 B2 * 4/2004 Methley et al. ..... 123/90.17
* cited by examiner

*Primary Examiner* — Ching Chang
(74) *Attorney, Agent, or Firm* — Harness, Dickey & Pierce, P.L.C.

(57) ABSTRACT

A cam phaser assembly may include a drive plate assembly, a cavity plate, and a driven plate assembly. The drive plate assembly may include a drive plate and a first vane fixed for rotation with the drive plate. The cavity plate may be rotationally driven by the drive plate and may define first and second chambers. The first vane may extend into the first chamber. The driven plate assembly may be rotationally driven by the drive plate assembly and may include a driven plate and a second vane fixed for rotation with the driven plate that extends into the second chamber.

20 Claims, 6 Drawing Sheets

FIG 6
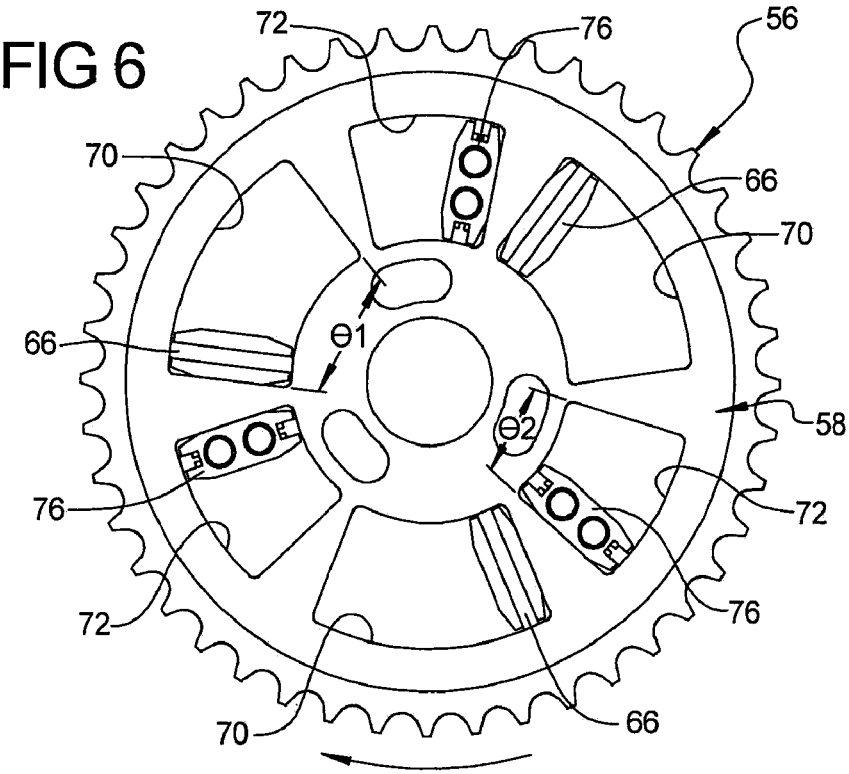
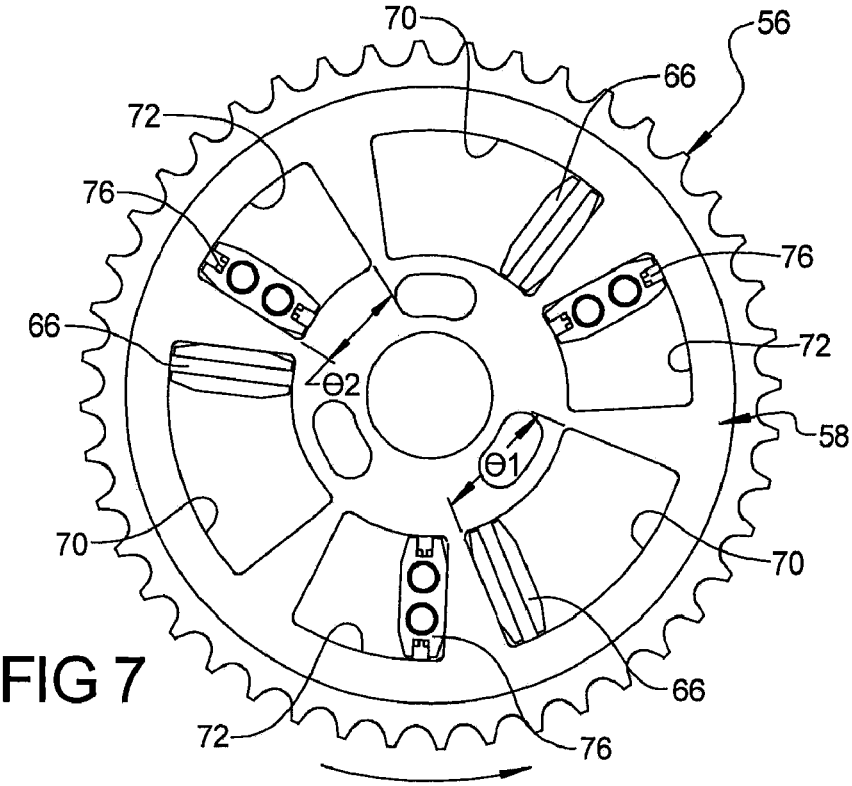
FIG 7

DUAL-EQUAL CAM PHASING WITH VARIABLE OVERLAP

FIELD

The present disclosure relates to cam phasers, and more specifically to dual-equal cam phasers with variable overlap.

BACKGROUND

The statements in this section merely provide background information related to the present disclosure and may not constitute prior art.

Engine assemblies may include a cam phaser that is coupled to an engine camshaft to adjust timing of intake and/or exhaust valve opening and closing events. Adjusting valve timing based on engine operating conditions may provide increased engine performance, such as increased power output, increased combustion stability, reduced fuel consumption, and/or reduced engine emissions. Modifying the range over which the intake and exhaust cam lobes may be advanced or retarded may provide for increased performance gains.

SUMMARY

A cam phaser assembly may include a drive plate assembly, a cavity plate, and a driven plate assembly. The drive plate assembly may include a drive plate and a first vane fixed for rotation with the drive plate. The cavity plate may be rotationally driven by the drive plate and may define first and second chambers. The first vane may extend into the first chamber. The driven plate assembly may be rotationally driven by the drive plate assembly and may include a driven plate and a second vane fixed for rotation with the driven plate that extends into the second chamber.

An engine assembly may include an engine structure, a cam phaser assembly supported on the engine structure, and a concentric camshaft assembly supported on the engine structure. The cam phaser assembly may include a drive plate assembly, a cavity plate, and a driven plate assembly. The drive plate assembly may include a drive plate and a first vane fixed for rotation with the drive plate. The cavity plate may be rotationally driven by the drive plate assembly and may define first and second chambers. The first vane may extend into the first chamber. The driven plate assembly may be rotationally driven by the drive plate assembly and may include a driven plate and a second vane fixed for rotation with the driven plate that extends into the second chamber. The concentric camshaft assembly may include first and second shafts that are rotatable relative to one another. The first shaft may be fixed for rotation with the cavity plate and the second shaft may be fixed for rotation with the driven plate.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 6 is a schematic illustration of the cam phaser assembly of FIG. 5 in a first orientation; and FIG. 7 is a schematic illustration of the cam phaser assembly of FIG. 5 in a second orientation.

DETAILED DESCRIPTION

Figure 1:
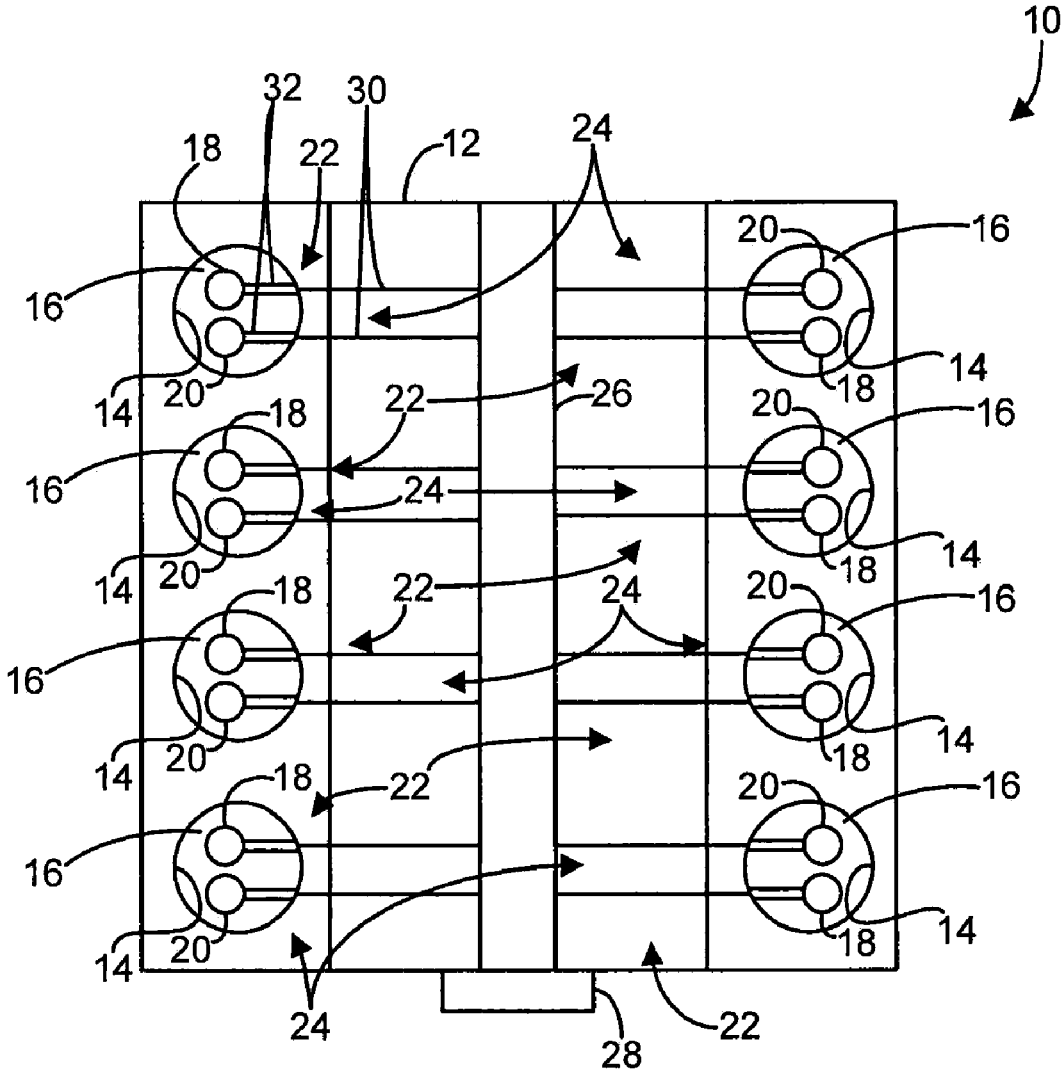
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Figure 2:
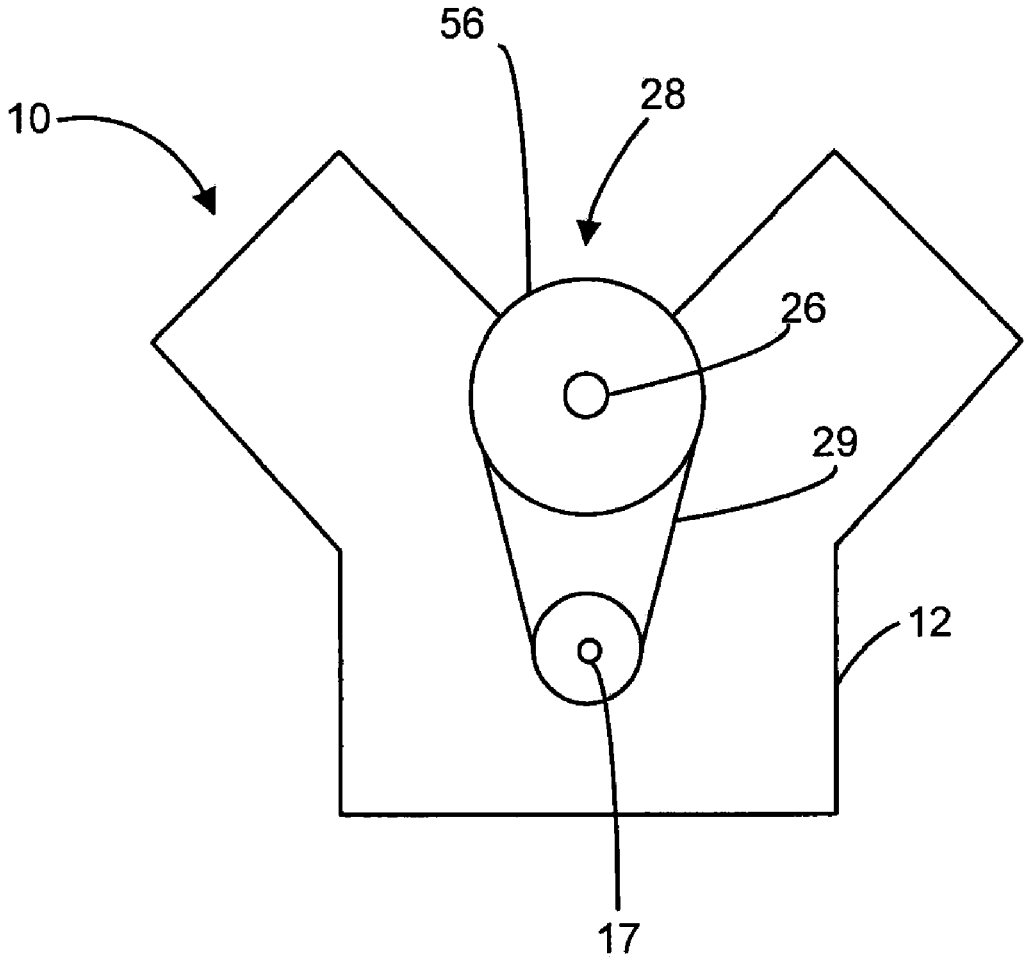
FIG. 2 is an additional schematic illustration of the engine assembly of FIG. 1.

Referring now to FIGS. 1 and 2, an exemplary engine assembly 10 is schematically illustrated. The engine assembly 10 may include an engine 12 including a plurality of cylinders 14 having pistons 16 disposed therein and a crankshaft 17. The crankshaft 17 may be rotatably supported by an engine structure and may be rotationally driven by the pistons 16. The engine 12 may further include an intake valve 18, an exhaust valve 20, intake and exhaust valve lift mechanisms 22, 24 for each cylinder 14, as well as a camshaft 26, a cam phaser assembly 28, and a drive belt 29 (such as a chain drive) that rotatably couples the crankshaft 17 to the cam phaser assembly 28.

The intake valve lift mechanisms 22 may each include a pushrod 30 and a rocker arm 32. The exhaust valve lift mechanisms 24 may each include a pushrod 30 and a rocker arm 32 as well. The camshaft 26 may be supported by an engine structure such as an engine block. The pushrods 30 may be engaged with the camshaft 26 to actuate the rocker arms 32 and open the intake and exhaust valves 18, 20. While the engine assembly 10 is illustrated as a pushrod engine assembly, it is understood that the present disclosure may be applicable to a variety of other engine configurations as well, such as overhead cam engines, where the camshaft 26 is supported by a cylinder head.

Figure 3:
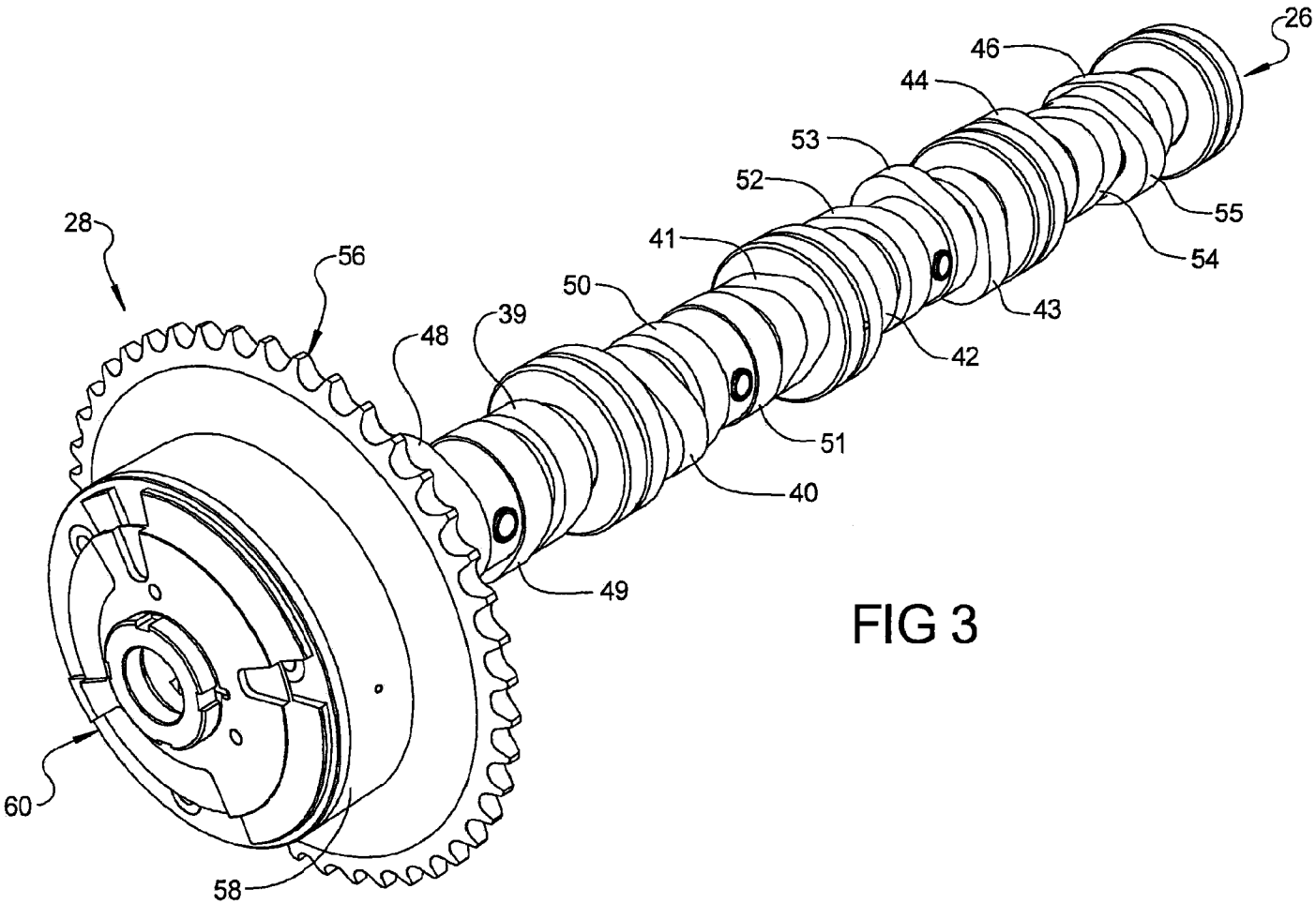
FIG. 3 is a perspective view of a camshaft and cam phaser assembly of the engine assembly of FIG. 1.
Figure 4:
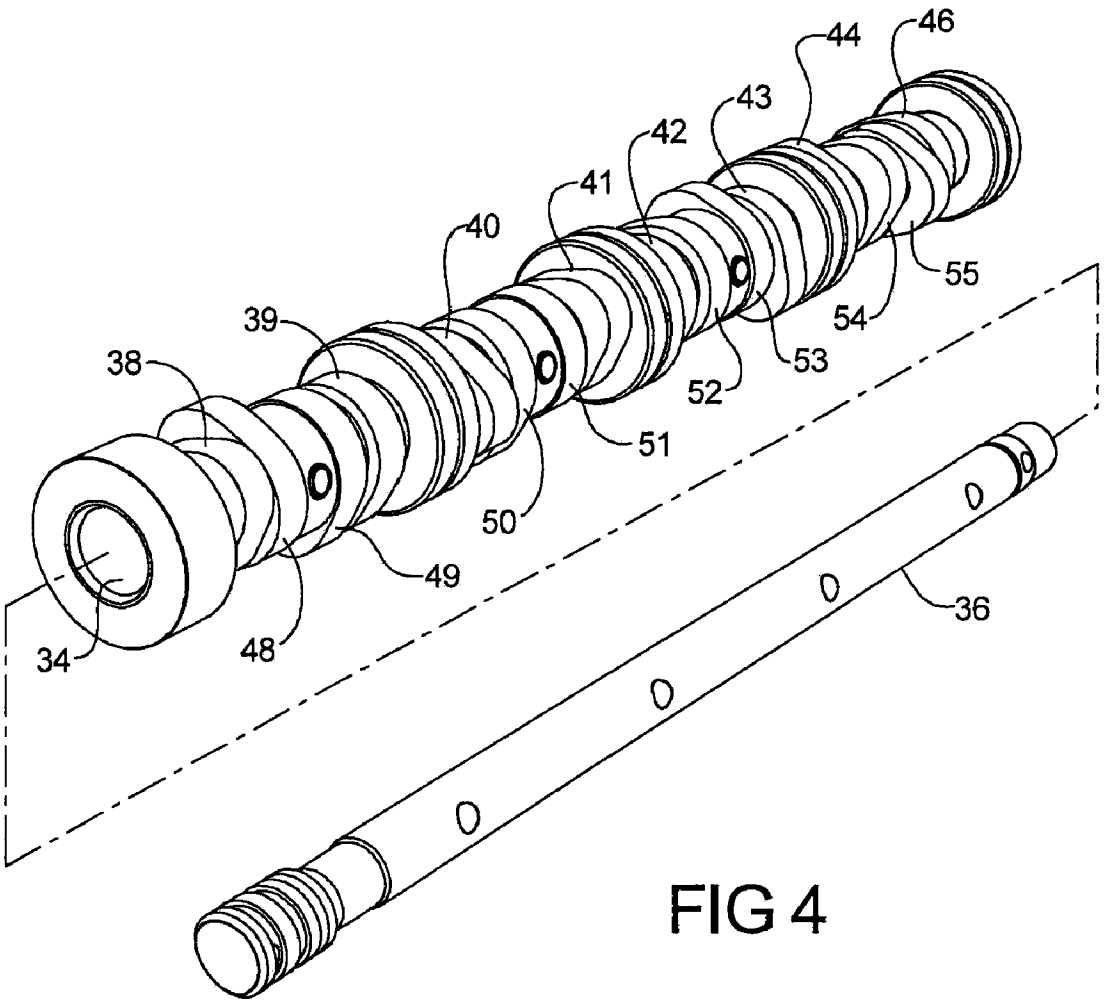
FIG. 4 is an exploded view of the camshaft assembly of FIG. 3.

With reference to FIGS. 3 and 4, the camshaft 26 may form a concentric camshaft assembly and may include first and second shafts 34, 36, a first set of lobe members 38, 39, 40, 41, 42, 43, 44, 46, and a second set of lobe members 48, 49, 50, 51, 52, 53, 54, 55. The second shaft 36 may be rotatably disposed within the first shaft 34. The first set of lobe members 38, 39, 40, 41, 42, 43, 44, 46 may be fixed for rotation with the first shaft 34 and the second set of lobe members 48, 49, 50, 51, 52, 53, 54, 55 may be fixed for rotation with the second shaft 36. In the present example, the first set of lobe members 38, 39, 40, 41, 42, 43, 44, 46 may form an intake lobe set and the second set of lobe members 48, 49, 50, 51, 52, 53, 54, 55 may form an exhaust lobe set. However, it is understood that alternate arrangements may be provided where the first set of lobe members 38, 39, 40, 41, 42, 43, 44, 46 may form an exhaust lobe set and the second set of lobe members 48, 49, 50, 51, 52, 53, 54, 55 may form an intake lobe set.

Figure 5:
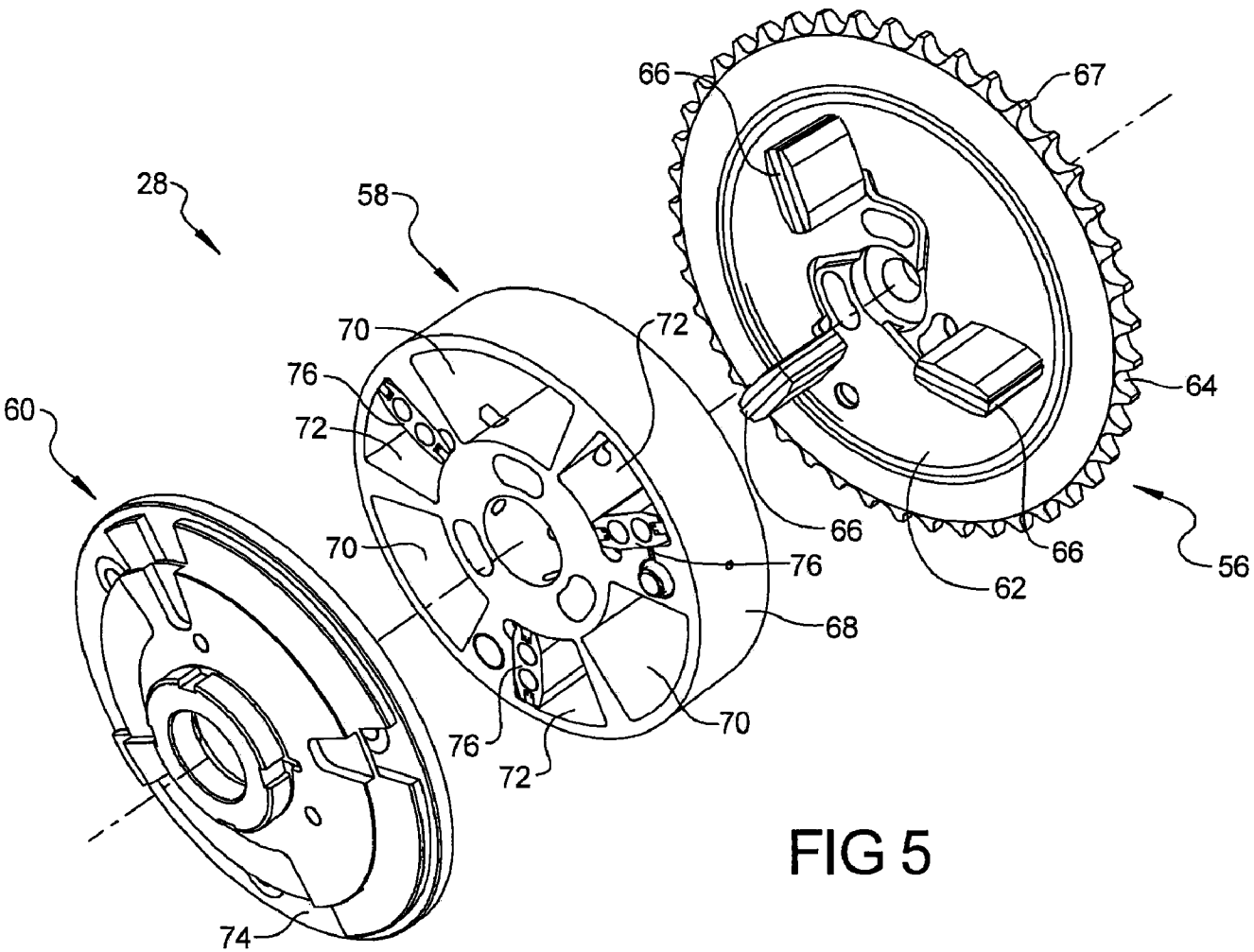
FIG. 5 is an exploded view of the cam phaser assembly of FIG. 3.

With reference to FIGS. 3 and 5, the cam phaser assembly 28 may include a drive plate assembly 56, a cavity plate 58, and a driven plate assembly 60. The drive plate assembly 56 may be rotatably supported on the engine structure and may include a drive plate 62, a drive hub 64, and a series of vanes 66. The drive hub 64 may be integrally formed on the drive plate 62 and may include a series of teeth 67. The drive hub 64 may be driven by the crankshaft through engagement with the belt 29 (seen in FIG. 2). The vanes 66 may be fixed for rotation with the drive plate 62. While the drive plate assembly 56 includes three vanes 66 in the present example, it is understood that more or fewer vanes may be used.

The cavity plate 58 may be located axially between the drive plate assembly 56 and the driven plate assembly 60. With additional reference to FIGS. 6 and 7, the cavity plate 58 may include a body 68 that defines a first set of chambers 70 and a second set of chambers 72. Each of the first chambers 70 may be equally spaced from one another and may have a first angular span ($\theta_1$) and each of the second chambers 72 may be equally spaced and may have a second angular span ($\theta_2$). The first angular span ($\theta_1$) may be significantly greater than the second angular span ($\theta_2$). More specifically, the first angular span ($\theta_1$) may be at least twice the second angular span ($\theta_2$). The first angular span ($\theta_1$) may be between 20 and 30 degrees and the second angular span ($\theta_2$) may be between 5 and 15 degrees. In the present example, the first angular span ($\theta_1$) may be approximately three times the second angular span ($\theta_2$). The number of first chambers 70 may correspond to the number of second chambers 72. The first chambers 70 may be located between adjacent ones of the second chambers 72.

The driven plate assembly 60 may include a driven plate 74 and a series of vanes 76. The vanes 76 are shown exploded from the driven plate 74 in FIG. 5. When assembled, the vanes 76 may be fixed for rotation with the driven plate 74. While the driven plate assembly 60 includes three vanes 76 in the present example, it is understood that more or fewer vanes may be used. The vanes 66 may extend axially into the first chambers 70 and the vanes 76 may extend axially into the second chambers 72.

The first shaft 34 may be fixed for rotation with the cavity plate 58 and the second shaft 36 may be fixed for rotation with the driven plate assembly 60. Therefore, when the first set of lobe members 38, 39, 40, 41, 42, 43, 44, 46 form an intake lobe set and the second set of lobe members 48, 49, 50, 51, 52, 53, 54, 55 form an exhaust lobe set, the intake lobe set may be fixed for rotation with the cavity plate 58 and the exhaust lobe set may be fixed for rotation with the driven plate assembly 60. Alternatively, the first shaft 34 may be fixed for rotation with the driven plate assembly 60 and the second shaft 36 may be fixed for rotation with the cavity plate 58.

During operation, pressurized fluid, such as engine oil, may be supplied to the first and second chambers 70, 72 to provide a hydraulic engagement between the vanes 66, 76 and the cavity plate 58. The hydraulic engagement may transfer rotation of the drive plate assembly 56 to the cavity plate 58 and to the driven plate assembly 60 to drive rotation of the camshaft 26. More specifically, the drive plate assembly 56 may drive rotation of the cavity plate 58 and the cavity plate 58 may drive rotation of the driven plate assembly 60. Thus, the drive plate assembly 56 may indirectly drive rotation of the driven plate assembly 60.

Based on the pressurized fluid supplied to the first and second chambers 70, 72, the cavity plate 58 and the driven plate assembly 60 may each be rotated relative to the drive plate assembly 56. More specifically, the cavity plate 58 may be rotated relative to the drive plate assembly 56 based on the pressurized fluid within the first chambers 70 being applied to the vanes 66. The driven plate assembly 60 may rotate with the cavity plate 58. Alternatively, the cavity plate 58 and the driven plate assembly 60 may be rotated relative to one another. The driven plate assembly 60 may be rotated relative to the cavity plate 58 based on the pressurized fluid within the second chambers 72 being applied to the vanes 76.

FIGS. 6 and 7 illustrate the cam phaser assembly 28 in first and second orientations. FIG. 6 generally illustrates each of the cavity plate 58 and the driven plate assembly 60 in a fully advanced position with the arrow representing a rotational direction of the cavity plate 58 and the driven plate assembly 60 relative to FIG. 7. FIG. 7 generally illustrates each of the cavity plate 58 and the driven plate assembly 60 in a fully retarded position with the arrow representing a rotational direction of displacement of the cavity plate 58 and the driven plate assembly 60 relative to FIG. 6. FIGS. 6 and 7 generally illustrate a maximum angular displacement for the cavity plate 58 relative to the drive plate assembly 56 and a maximum angular displacement for the driven plate assembly 60 relative to the drive plate assembly 56. The maximum angular displacement for the cavity plate 58 relative to the drive plate assembly 56 may be approximately equal to the first angular span ($\theta_1$) and the maximum angular displacement for the driven plate assembly 60 relative to the drive plate assembly 56 may be approximately equal to the sum of the first and second angular spans ($\theta_1+\theta_2$). The maximum angular displacement for the driven plate assembly 60 relative to the cavity plate 58 may be approximately equal to the second angular span ($\theta_2$).

Therefore, since the first and second shafts 34, 36 may be fixed for rotation with the cavity plate 58 and the driven plate assembly 60, each of the first and second shafts 34, 36 may be rotatable relative to the drive plate assembly 56. Additionally, due to the engagement between the driven plate assembly 60 and the cavity plate 58, rotation of the cavity plate 58 relative to the drive plate assembly 56 may result in rotation of the driven plate assembly 60 relative to the drive plate assembly 56. In the arrangement where the exhaust cam lobe set is fixed for rotation with the driven plate assembly 60 and the intake lobe set is fixed for rotation with the cavity plate 58, the exhaust cam lobe set may be rotatable relative to the drive plate assembly 56 and the cavity plate 58 to the same degree as the driven plate assembly 60. The intake cam lobe set may be rotatable relative to the drive plate assembly 56 to the same degree as the cavity plate 58.

What is claimed is:

1. A cam phaser assembly comprising:

a drive plate assembly including a drive plate and first vanes fixed for rotation with the drive plate;

a cavity plate that is rotationally driven by the drive plate and defining first and second chambers isolated from one another, the first vanes extending into the first chambers; and a driven plate assembly that is rotationally driven by the drive plate assembly and including a driven plate and second vanes fixed for rotation with the driven plate and extending into the second chambers.

2. The cam phaser assembly of claim 1, wherein the drive plate includes a hub that is adapted to be driven by a belt.

3. The cam phaser assembly of claim 1, wherein the driven plate is rotationally driven by the cavity plate.

4. The cam phaser assembly of claim 3, wherein the cavity plate is rotatable relative to the drive plate.

5. The cam phaser assembly of claim 4, wherein the driven plate is rotatable relative to the cavity plate.

6. The cam phaser assembly of claim 5, wherein the first chambers define a first angular span for rotation of the cavity plate relative to the drive plate and the second chambers define a second angular span for rotation of the driven plate relative to the cavity plate, the first angular span being greater than the second angular span.

7. The cam phaser assembly of claim 6, wherein a maximum angular displacement of the driven plate relative to the drive plate is greater than a maximum angular displacement of the cavity plate relative to the drive plate.

8. The cam phaser assembly of claim 7, wherein the maximum angular displacement of the driven plate is generally equal to the sum of the first and second angular spans and the maximum angular displacement of the cavity plate is generally equal to the first angular span.

9. The cam phaser assembly of claim 6, wherein the first angular span is at least twice the second angular span.

10. An engine assembly comprising:

an engine structure;

a cam phaser assembly supported on the engine structure and including:

a drive plate assembly including a drive plate and first vanes fixed for rotation with the drive plate;

a cavity plate that is rotationally driven by the drive plate assembly and defining first and second chambers isolated from one another, the first vanes extending into the first chambers; and a driven plate assembly that is rotationally driven by the drive plate assembly and including a driven plate and second vanes fixed for rotation with the driven plate and extending into the second chambers; and a concentric camshaft assembly supported on the engine structure and including first and second shafts that are rotatable relative to one another, the first shaft being fixed for rotation with the cavity plate and the second shaft being fixed for rotation with the driven plate.

11. The engine assembly of claim 10, further comprising a crankshaft supported on the engine structure and drivingly engaged with the drive plate.

12. The engine assembly of claim 10, wherein the driven plate is rotationally driven by the cavity plate.

13. The engine assembly of claim 12, wherein the cavity plate is rotatable relative to the drive plate.

14. The engine assembly of claim 13, wherein the driven plate is rotatable relative to the cavity plate.

15. The engine assembly of claim 14, wherein the first chambers define a first angular span for rotation of the cavity plate relative to the drive plate and the second chambers define a second angular span for rotation of the driven plate relative to the cavity plate, the first angular span being greater than the second angular span.

16. The engine assembly of claim 15, wherein a maximum angular displacement of the driven plate relative to the drive plate is greater than a maximum angular displacement of the cavity plate relative to the drive plate.

17. The engine assembly of claim 16, wherein the maximum angular displacement of the driven plate is generally equal to the sum of the first and second angular spans and the maximum angular displacement of the cavity plate is generally equal to the first angular span.

18. The engine assembly of claim 15, wherein the first angular span is at least twice the second angular span.

19. The engine assembly of claim 15, wherein the concentric camshaft assembly includes intake cam lobes fixed for rotation with the first shaft and exhaust cam lobes fixed for rotation with the second shaft.

20. The engine assembly of claim 10, further comprising intake and exhaust valves supported on the engine structure, both the intake and exhaust valves being actuated by the concentric camshaft assembly.

* * * * *